US005234204A

United States Patent [19]

Hunt

[11] Patent Number: 5,234,204

[45] Date of Patent: Aug. 10, 1993

[54] DEVICE FOR ASSEMBLING INTERLOCKING ROAD MAT SEGMENTS FOR TEMPORARY ROADS

[76] Inventor: James W. Hunt, P.O. Box 489, Edna, Tex. 77957

[21] Appl. No.: 554,253

[22] Filed: Jul. 17, 1990

[51] Int. Cl.[5] ..... B25B 5/00

[52] U.S. Cl. ..... 269/41; 269/43; 269/910; 29/281.3

[58] Field of Search ..... 269/296–299, 269/303, 910, 41, 43; 100/913; 29/281.3; 227/152, 154, 155

[56] References Cited

U.S. PATENT DOCUMENTS

| | | | |
|---|---|---|---|
| 2,749,873 | 6/1956 | Huffman | 269/910 |
| 2,754,862 | 7/1956 | Kemp | 269/910 |
| 3,866,644 | 2/1975 | Stubbs | 269/910 |
| 3,933,348 | 1/1976 | Tidwell | 269/910 |
| 4,146,954 | 4/1979 | Day | 269/910 |
| 4,154,436 | 5/1979 | Sellers | 269/910 |
| 4,998,336 | 3/1991 | Papsdorf | 269/910 |
| 5,031,886 | 7/1991 | Sosebee | 269/910 |

*Primary Examiner*—Robert C. Watson
*Attorney, Agent, or Firm*—David M. Ostfeld

[57] ABSTRACT

A three-dimensional frame structure for the construction of road mats is disclosed. The structure includes the components of the mat positioned to insure uniformity of assembly of mats of different sizes, with a single end structure that acts as a template and with means for moving a mat for final affixing onto a table while permitting the assembly holding structure to be repositioned for constructing another mat.

A method of manufacture for road mats which utilizes a frame to position the components of the mat during the mat's manufacture into a predetermined arrangement to ensure the uniformity of each mat for interchange use in the field is also disclosed, whereby mats may be completed by the apparatus while other mats are being assembled.

A temporary road comprised of two sets of mats is also disclosed. The first set of mats is laid down such that its smooth surface is on the ground. A second set of mats is interlaced so that each mat of the second set overlays one-half of two adjacent mats of the first set or, alternatively, overlays four mutually touching first set of mats. Channels and corresponding transverse elements are provided in both the first and second set of mats to permit the overlap by approximately one-half of a mat of the first set with mats of the second set.

4 Claims, 6 Drawing Sheets

DEVICE FOR ASSEMBLING INTERLOCKING ROAD MAT SEGMENTS FOR TEMPORARY ROADS

BACKGROUND OF THE INVENTION

This invention relates to a unique and improved series of designs for a device to construct interlocking road mat segments for temporary roads. Such mat segments (or "mats") are typically used where there is a temporary need for roads to carry heavy vehicular traffic, such as trucks, where the ground surface could not otherwise support such heavy vehicles (such as low lying marshlands) and where the temporary need for a road and the expense involved in constructing a permanent road would not justify the construction of a permanent road. The mats contemplated by the present invention are typically made of heavy wood timbers, are of a uniform size and construction, and are often constructed to interlock to provide a more secure roadway. Such mats might be constructed by hand or, as is now known in the prior art, with the assistance of an apparatus such as that described in U.S. Pat. No. 4,922,598 dated May 8, 1990.

The device taught by the present invention incorporates significant improvements over earlier designs of mat-fabrication devices, such improvements including the use of the unique template to construct a uniquely-designed double layer interlocking mat and the use of a hydraulic-powered mechanism to turn a partially-constructed mat upside down on to a specially-designed crimping table for crimping the ends of nails as they are driven into the timbers out of which each mat is constructed.

SUMMARY OF THE INVENTION

The present invention teaches a device for assembling interlocking mat segments for construction of temporary roads. More specifically, the device taught by the present invention comprises two uniquely-designed assembly tables which allow a mat under construction to be quickly assembled and then nailed on both sides in a manner which in the second part of the assembly crimps the ends of nails on one side to more securely fasten the component pieces of each mat, while permitting another mat to begin the first part of assembly. The device further permits the making of one type of mat and then quickly switching to a configuration for another type of mat.

The preferred embodiment of the mats includes two types of mats which permit the top mat to more securely hold the mat assembly together because of its superior weight. Although the preferred embodiment of the present invention teaches a construction of a double-layered system of interlocking mats, comprised of bottom mats which interlock with top mats, the unique features of the present invention can also be used to construct mats for a single-layered mat system or any number of mat designs.

BRIEF DESCRIPTIONS OF THE DRAWING

For a further understanding of the nature and object of the present invention, reference is made to the following drawing in which like parts are given like reference numbers and wherein:

FIG. 1 is a surface view of the interlocking portions at top mat and the bottom mat that is constructed with the present invention using the preferred embodiment as described herein. The other surface at each mat is a set of lateral boards that either lie on the ground surface (for the bottom mat) or form the roadway (for the top mat).

DESCRIPTION OF THE PREFERRED EMBODIMENT

Figure 1A:
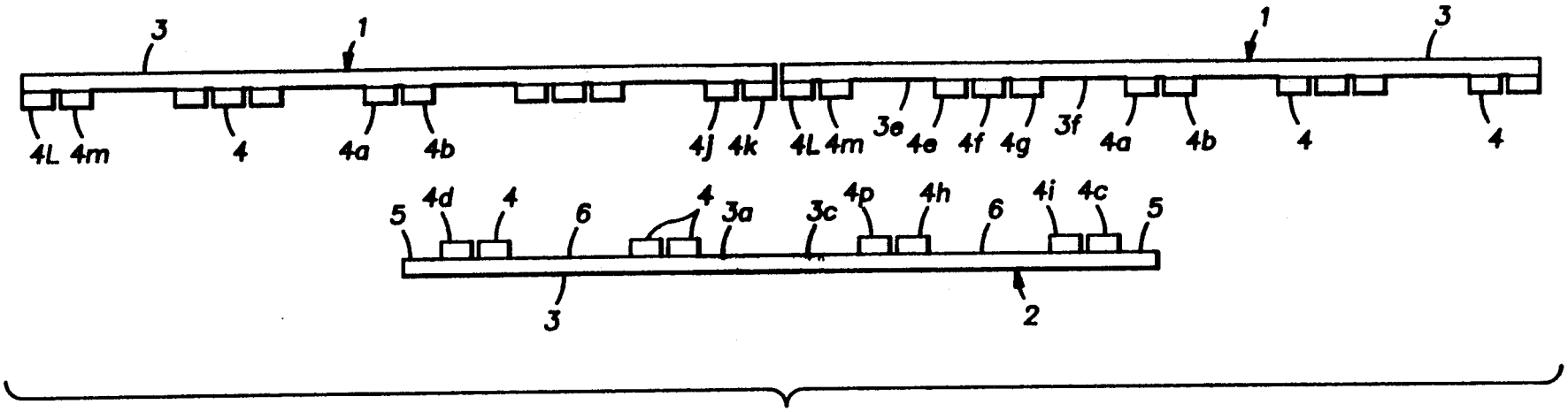
FIG. 1A is a side view of two top mats juxtaposed with a bottom mat.
Figure 1B:
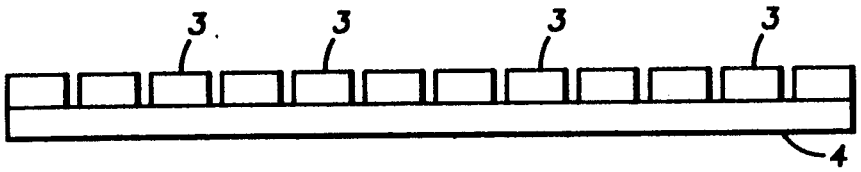
FIG. 1B is an end view of a top or bottom mat.
Figure 1C:
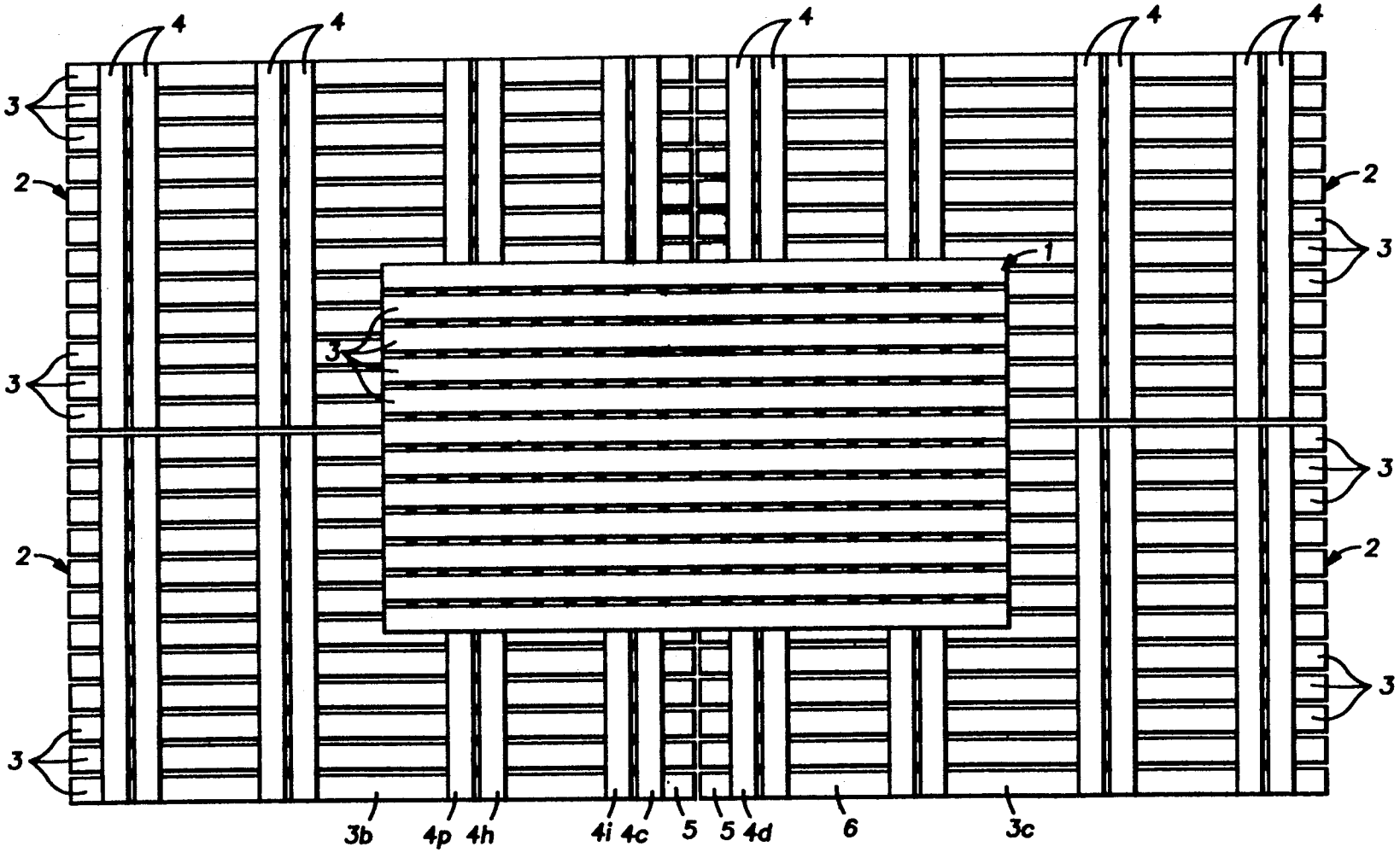
FIG. 1C is a plan view of a top mat laying on four bottom mats.

Referring first to FIG. I, FIG. 1 depicts the preferred system of mats that are constructed by the device of the preferred embodiment of the present invention. The system of mats comprises a top mat 1 and a bottom mat 2. Each mat 1, and 2 is comprised of a series of members 3, such as wooden timbers, running lengthwise and a series of members 4, such as wooden timbers, running crosswise. In the construction of a temporary road, two bottom mats 4 are laid end to end as shown in FIG. 1 with crosswise members 4 on the upper side and the lengthwise members 3 on the lower side next to the ground. The top mat 1 is then laid in an overlapping manner over both bottom mats 2, with the crosswise members 4 of the top mat 1 facing down and the lengthwise members 3 of the top mat 1 facing up, forming the surface of the temporary road. In order to cause the top mat 1 to interlock with the two bottom mats 2 to provide a constant, non-shifting road surface, crosswise members 4*a* and 4*b* of the top mat 1 are fitted into the slot 5 formed by the crosswise members 4*c* of one bottom mat 2 and 4*d* of the other bottom mat 2, such slot 5 being more or less equal in width to the combined width of crosswise members 4*a* and 4*b*. Similarly, crosswise members 4*e*, 4*f*, and 4*g* of the top mat 1 are fitted into the slot 6 formed by the crosswise members 4*h* and 4*i* of the left (looking down on FIG. 1) bottom mat 2, such slot 6 being more or less equal in width to the three crosswise members 4*e*, 4*f*, and 4*g*. Corresponding slots 3*e*, 3*f*, 5, 6, are formed by crosswise members 4*m*, 4*e* and 4*g*, 4*a* in upper mat to accommodate crosswise members 4*h*, 4*p* and 4*a* 4*c*, respectively. The same pattern is repeated for the remaining crosswise members 4 of top mat 1, such that each side-by-side set of crosswise members 4 of top mat 1 fits into a slot of more or less equal width formed by crosswise members 4 of the bottom mats 2, except the end crosswise members 4*j*, 4*k*, 4*l*, 4*m*. Crosswise members 4*l*, 4*m* fit into one-half 3*b* of slot 3*a*, the other half of slot 3*a* being substantially filled by the crosswise members 4*j*, 4*k* of another top mat 1 (not shown). Similarly, crosswise members 4*p*, 4*h* of top mat 1 fit into one-half 3*d* of slot 3*c*, the other half of slot 3*c* being substantially filled by the crosswise members 4*l*, 4*m* of another top mat 1 (not shown) In this manner, top mat 1 has twelve crosswise members 4 giving it greater weight than bottom mat 2 which aids in stabilizing the road.

Alternatively, for a wider road, crosswise members 4 may be placed to fill only one-half of slots 3*a*, 3*c*, 3*e*, 3*f*, 5, 6, of mats 1, 2 and the other half of the crosswise members 4 may be placed to fill one-half at slots 3*a*, 3*c*, 3*e*, 3*f*, 5, 6 of length-wise adjacent mats so that one mat 1 may have crosswise members 4 partially in the slots 3*a*, 3*c*, 3*e*, 3*f*, 5, 6 at four mats 2, with each mat 2 being width-wise adjacent to another mat 2 and length-wise adjacent to another mat 2 that are linked by mat 1.

Figure 2:
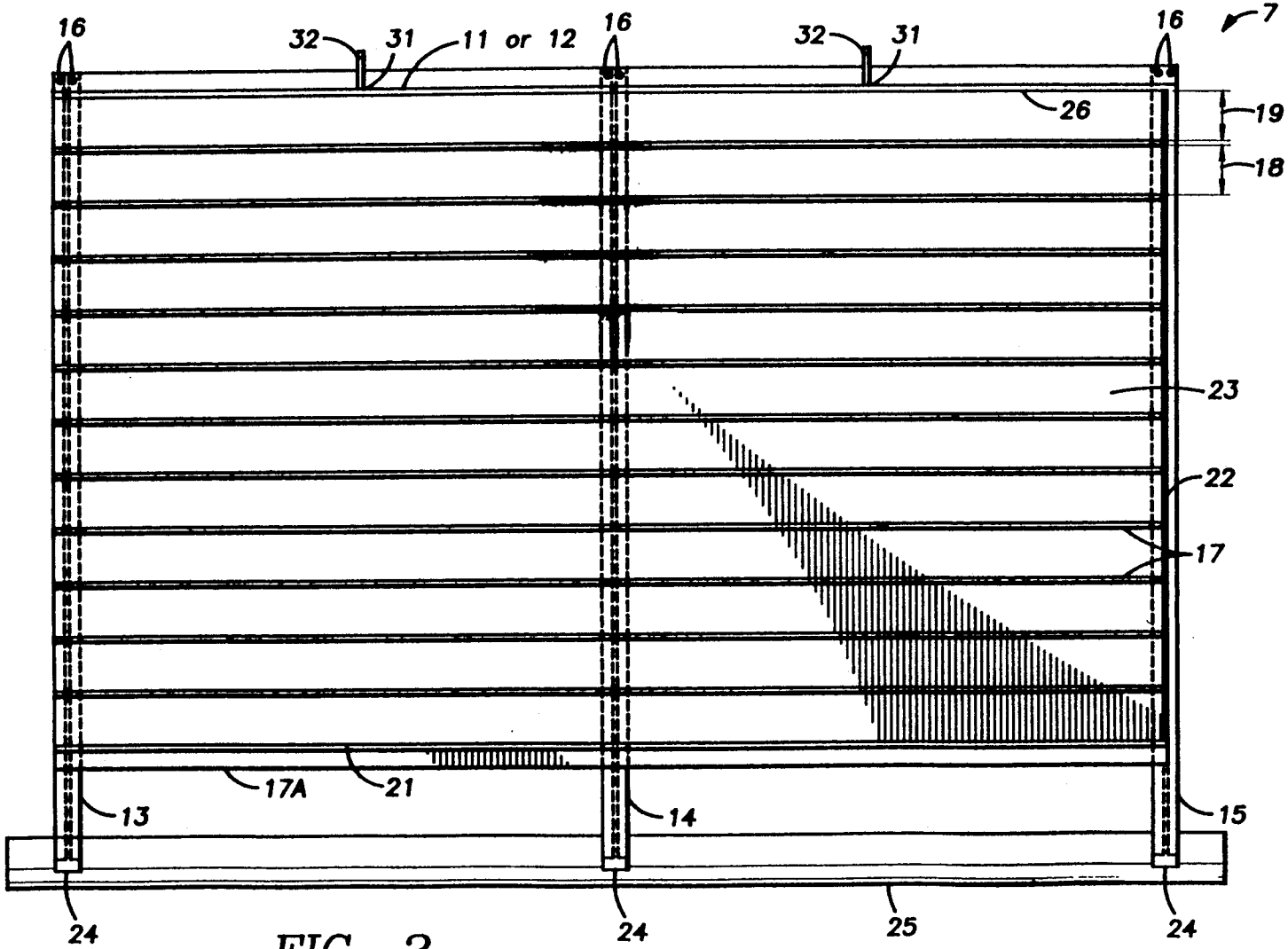
FIG. 2 is a surface view of the assembly frame of the present invention.
Figure 3:
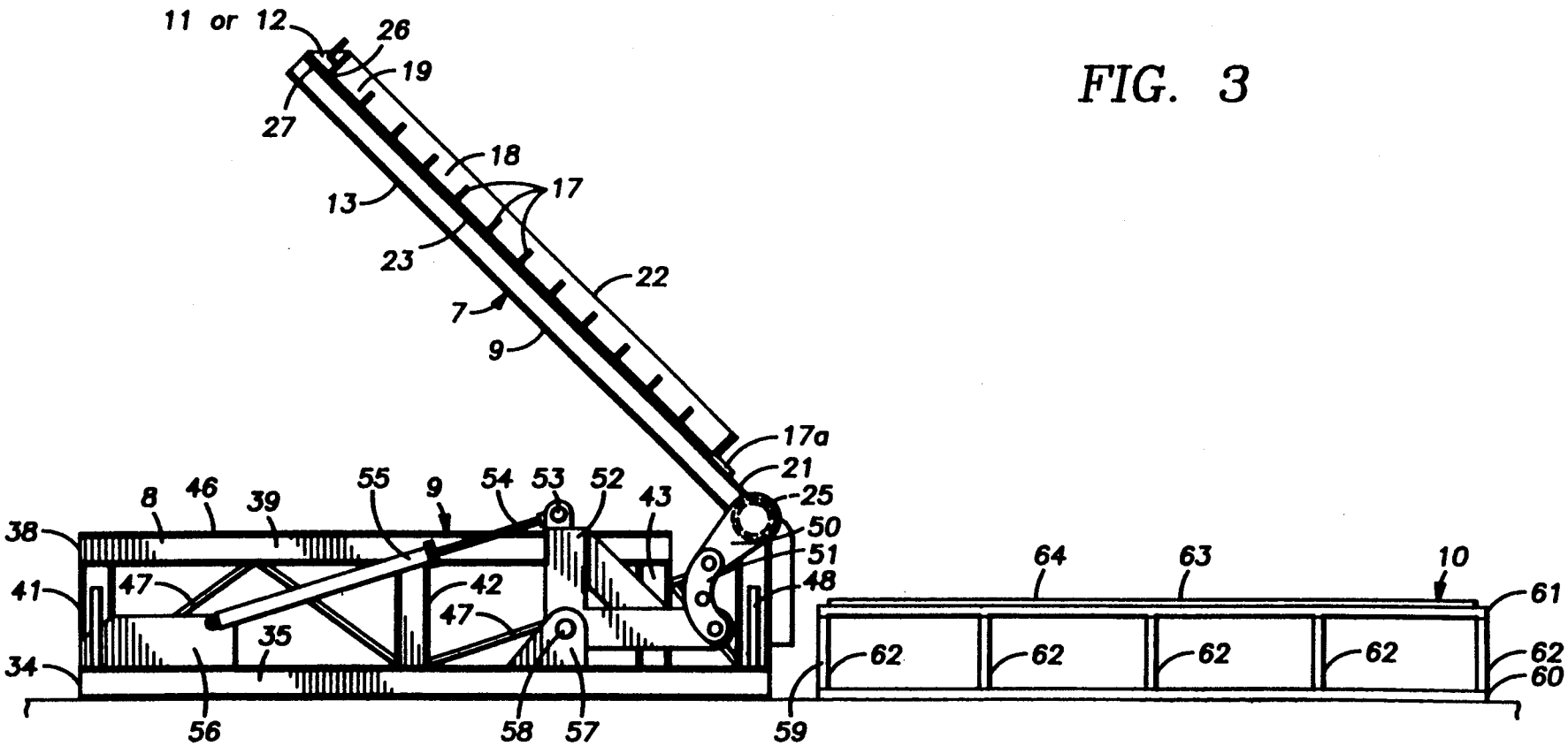
FIG. 3 is a side view of the primary assembly table (which includes the assembly frame) of the present invention with a crimping table placed to the right of the primary assembly table.
Figure 4:
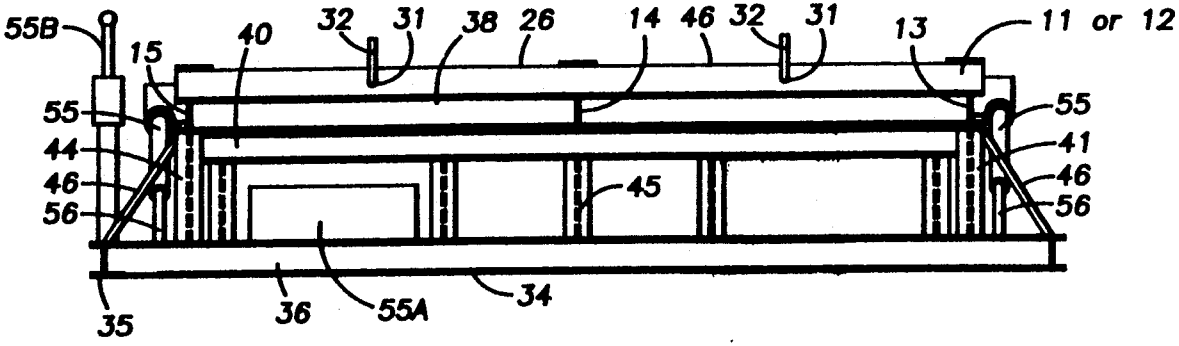
FIG. 4 is a side view of the non-pivoting end of the primary assembly table of the present invention.
Figure 5:
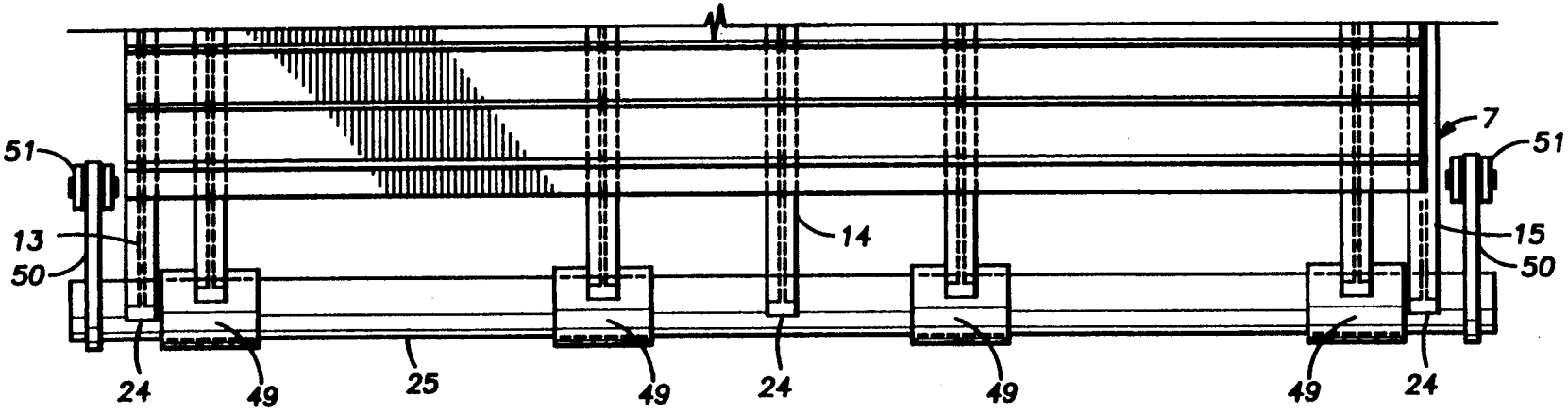
FIG. 5 is a plan view of the pivoting end of the assembly frame of the present invention.
Figure 6:
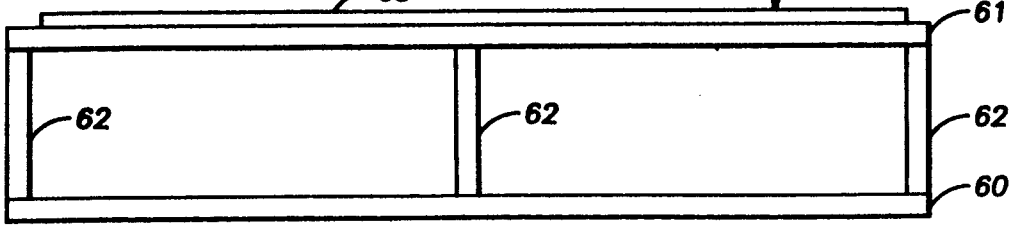
FIG. 6 is a side view of a short end of the crimping table of the present invention.

Describing now the device taught by the present invention to construct the mats 1 and 2 described above, FIG. 2 illustrates a surface view of the assembly frame 7, and FIG. 3 illustrates a side view of assembly frame 7 and the assembly frame base 8, together comprising the primary assembly table 9. FIG. 4 illustrates a side view of the left end of the primary assembly table 9 as show in FIG. 3, and FIG. 5 illustrates the right end of the assembly frame 7 where it pivots on assembly frame base 8 as shown in FIG. 3. FIG. 3 also illustrates, to the right of primary assembly table 9, a side view of crimping table 10 laid end-to-end against primary assembly table 9. FIG. 6 illustrates one of the two shorter sides of crimping table 10, one of which is set next to primary assembly table 9 as illustrated in FIG. 3. Finally, FIG. 7 illustrates the two types of templates 11 and 12 that are attached to assembly frame 7 for the construction of a top mat 1 or a bottom mat 2, respectively.

Assembly frame 7 may be constructed as follows, although the materials used and the size, weight, and dimensions of the frame 7 may vary depending upon such variables as the materials being used to construct the mats or the design or dimensions of the mat being constructed. Three steel I-beams 13, 14, 15, running the shorter length ("crosswise") of assembly frame 7 form the foundation of the assembly frame 7. Referring to FIG. 2, beams 13, 15 form the left and right crosswise edges of assembly frame 7, respectively, and beam 14 runs crosswise down the center of assembly frame 7.

Referring to FIG. 2 and FIG. 3, at the upper or left end of crosswise beams 13, 14, and 15, template 11 or 12 (each described in further detail below) is bolted by bolt assembly 16 along the longer length ("lengthwise") of assembly frame 7. Also running the lengthwise of assembly frame 7 is a parallel series of smaller steel inverted T-beams or angle braces 17, spaced so that the lengthwise space 18 between the upright portions of any two of the beams 17 is slightly greater than the width of the lengthwise members 3 (e.g., wooden timbers) used to construct the mats 1, 2. Each of the lengthwise beams 17, which are approximately equal in length to template 11 or 12, is welded to crosswise beams 13, 14, 15. Referring again to FIG. 2 and FIG. 3, the uppermost beam 17 nearest template 11 or 12 is situated so that the lengthwise space 19 between the upright portion of such uppermost beam 17 and the upright portion 26 of template 11 or 12 is equal to the space 18 between the upright portions of two lengthwise beams 17. As an alternative to inverted T-beams, the lengthwise beams 17 could consist of L-beams or angle braces arranged consistently so that the space 18 between the upright portions of any two beams 17 is the same as if T-beams had been used as described above.

The bottommost lengthwise beam 17*a* is a steel L-beam of heavier weight and greater size (as discussed below) than the other lengthwise beams 17, with an upright portion 21 of approximately the same height as the upright portion 26 of template 11 or 12, whereas the height at the upright position at the other lengthwise beams 17 is approximately that of the height of slot 30 (FIG. 7). Still referring to FIG. 2, at the right (facing FIG. 2) crosswise edge of assembly frame 7, a steel plate 22 of the same height as the upright portion 26 of template 11 or 12 and the upright portion 21 of lengthwise beam 17*a* is welded to the rightmost ends of template 11 or 12 and of each of the lengthwise beams 17, including beam 17*a*.

Between each pair of lengthwise beams 17 (including beam 17*a*) and between template 11 or 12 and the uppermost lengthwise beam 17, a flat steel plate 23 of the same thickness as the lower, flat portion of each lengthwise beam 17 and of slightly less width than the space between each pair of lengthwise beams 17, and of the same length as the lengthwise beams 17, is welded onto crosswise beams 13, 14, and 15, providing a continuous lengthwise surface onto and over which lengthwise members 3 can be slid into the assembly frame 7 for the construction of a mat 1 or mat 2.

Referring to FIG. 2 and FIG. 3, the bottom or right end of each of crosswise beams 13, 14, and 15, hereinafter referred to as the pivoting end 24, extends a short distance beyond the bottommost lengthwise beam 17*a*. Each pivoting end 24 is cut out in an outward-facing semi-circular shape and is welded onto a lengthwise tubular steel axle 25.

Figures 7A, 7B:
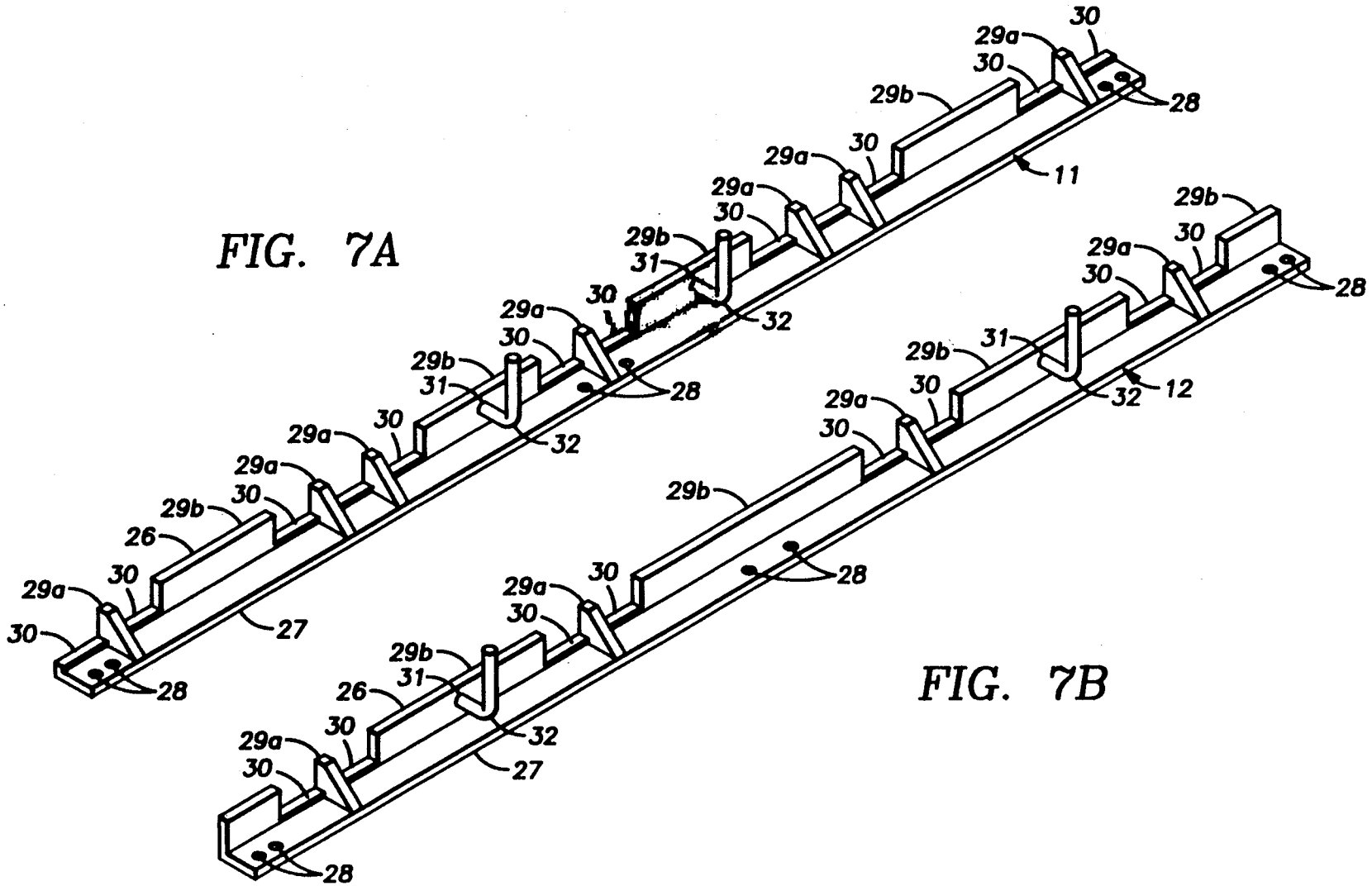
FIG. 7 is a view of the two mat templates that are used to construct each of the top mat (FIG. 7*a*) and the bottom mat (FIG. 7*b*), respectively, that is constructed by the preferred embodiment of the present invention.

Referring now principally to FIG. 7, each of template 11 or 12 comprises essentially a steel L-shaped beam or angle brace, the view of the upright portion 26 of which in FIG. 7 is primarily that which is opposite to the side which is juxtaposed to lengthwise beams 17. The horizontal portion 27 of each of template 11 or 12 contains bolt holes 28 which permit the template 11 or 12 to be bolted by bolt system 16 onto the upper end of each of crosswise beams 13, 14, and 15 of assembly frame 7. The upright portion 26 of each template 11 or 12 is not solid but rather comprises a series of raised portions 29*a*, 29*b* and slots 30, such portions 29*a*, 29*b* and slots 30 arranged in the format reflecting the spacing of the crosswise members 4 of mats 1 and 2, respectively. Each slot 30 is slightly larger than the width of each crosswise member 4, and the raised portions 29*a*, 29*b* comprise either a short peg 29*a* to provide spacing between two side-by-side crosswise members 4, or a solid portion 29*b* equal in length to the width of one or more crosswise members 4 plus the width of spaces between any two side-by-side crosswise members 4. The arrangement of raised portions 29*a*, 29*b* and slots 30 of top mat template 11 (FIG. 7*a*) reflects the arrangement of crosswise members 4 of top mat 1 shown in FIG. 1, and the arrangement of raised portions 29*a* and 29*b* and slots 30 of bottom mat template 12 (FIG. 7*b*) reflects the arrangement of crosswise members 4 of bottom mat 2 shown in FIG. 1. Each of two raised portions 29*b* of each template 11 or 12 contains a hole 31 into which is fitted an L-shaped rounded pin 32 which can move freely in and out of hole 31. The height of slots 30 is approximately equal to the thickness of lengthwise members 3 so that crosswise members 4 may be laid directly on top of lengthwise members 3. Pins 32 are positioned to retain lengthwise members 3 in contact with plates 23 during the raising of assembly frame 7 as discussed below.

The assembly frame base 8, as shown in FIG. 3 and FIG. 4, may be constructed in any of a number of designs and configurations to provide sufficient support for the assembly frame 7 and to accommodate the hydraulic and pivoting machinery described below. In the preferred embodiment, a rectangular base 34 is formed of steel I-beams 35 and short steel I- beams 36 welded end-to-end (see FIG. 4), creating a rectangular perimeter. Additional I-beams running parallel to either the long beams 35 or the short beams 36 may be added within the perimeter of base 34 to provide additional structural strength to the assembly frame base 8 as a whole or to support hydraulic machinery described below.

An upper perimeter 38 of steel I-beams provides direct support for the assembly frame 7. This upper perimeter 38 is comprised of a rectangle of horizontal steel I-beams 39 (FIG. 3) and 40 (FIG. 4) and is supported by and attached to the lower base 34 by eight vertical steel I-beams 41–45 (three beams not shown), the length of which are such that, when all of the above-referenced I-beam members of assembly frame base 8 are assembled, the top surface 46 of the upper perimeter 38 will be above the ground sufficient for convenient insertion of members 3,4 when base 34 is resting on the ground, with the perimeter 38 parallel to the crosswise beams 13 and 15 of assembly frame 7 and parallel to the lengthwise beams 17 of the assembly frame 7. Additional bracing support is provided by diagonal angle braces 47 placed between vertical beams 41–45 (and the three vertical beams not shown) and diagonal angle braces 46 (FIG. 4) welded at the bottom end to either long beam 35 of base 34 and welded at the top end to either long side of upper perimeter 38 of assembly frame base 8.

Referring to FIG. 3 and FIG. 5, at the far right (as viewed facing FIG. 3) end of assembly frame base 8 is a series of four vertical steel I-beams 39 welded at the bottom to the rightmost short beam 36 (not shown) of base 34. The beams 39 are spaced so that, referring to FIG. 5, the leftmost beam 39 (as viewed facing FIG. 5) situated just inside pivoting end 24 of crosswise beam 13 of assembly frame 7, the rightmost beam 39 is situated just inside pivoting end 24 of crosswise beam 15 of assembly frame 7, and the other two beams 39 are situated equidistant between the two outside beams 39. Diagonal angle braces 48 provide additional support to each of the two outside beams 39 (FIG. 3).

At the end of each of the beam 39 is welded a steel ring 49. Tubular axle 25 fits through and is supported by all four rings 49 and beams 39. Each end of axle 25 is welded to a steel piece 50, which in turn is bolted to two matching steel pieces 51 in a manner which allows both piece 50 and pieces 51 to pivot freely on the connecting bolt, and in turn pieces 51 are bolted to steel piece 52 in a manner which allows both pieces 51 and piece 52 to pivot freely on the connecting bolt. In turn, piece 52 is attached by pin 53 (FIG. 3) to the end of piston rod 54 of either of two hydraulic rams 55, one situated on each side of the assembly frame base 8 and secured to assembly frame base 8 by attachment to steel plate 56 on either side of assembly frame base 8. Each steel plate 56 is welded to vertical beams 41 and 44. Steel piece 52 is further supported by steel plate 57 and is attached to steel plate 57 by means of bolt 58, which allows piece 52 to move freely. Hydraulic machinery 55A and controls 55B are situated on assembly frame base 8 as shown in FIG. 4.

Crimping table 10 is a free-standing apparatus, although in the operation of the invention it will be placed with one short end 59 in close proximity to primary assembly table 9, as shown in FIG. 3. Crimping table 10 is constructed essentially of steel L-angle or tubular brace pieces, comprising one lower horizontal rectangular frame 60 which rests on the ground and one upper horizontal rectangular frame 61. Upper frame 61 is supported above and attached to lower frame 60 by a series of vertical braces 62. On top of upper frame 61 is placed a solid steel plate 63 of three-eighths inch thickness and of approximately the same dimensions as upper frame 61, and which is spot welded on all sides to upper frame 61. The length of vertical braces 62 are such that, when the crimping table 10 is resting on the ground, the top surface 64 of crimping table 10 is lower to the ground than top surface 46 of assembly frame base 8 by a distance roughly equal to the vertical width of assembly frame 7 from the top of upright portions 26, 21 to the bottom of crosswise beams 13–15 when the assembly frame 7 is laying horizontal on assembly frame base 8.

DESCRIPTION OF THE PREFERRED USE OF THE INVENTION

The present invention as incorporated in the preferred embodiment described above will typically be operated by a crew of between four to six workers, two to three of which will load timbers onto assembly frame 7 as explained below, one of which will control the hydraulic machinery of the invention, and one or two of which will perform the nailing, preferably with an automatic nail gun which might be electrically, pneumatically, or hydraulically powered (not shown). Presuming that the mats or 2 will be constructed of heavy wooden timbers, the process of the construction of a mat would commence with the assembly frame 7 lying against the top surface 46 of assembly frame base 8 and with the appropriate template 11 or 12 bolted to the assembly frame 7. Workers will load lengthwise members 3 into each of the spaces 18, 19 of assembly frame 7, such process simplified by the support provided by steel plates 23 in each space 18, 19 and the guiding effect of the upright portions of each of the lengthwise beams 17 (including 17*a*) and the upright portions 26 of template 11 or 12. Each lengthwise member 3 is pushed into assembly frame 7 until the front end of the member 3 abuts against upright steel plate 22.

When all of the lengthwise beams 3 have been put in place on assembly frame 7, workers will then load crosswise members 4 onto assembly frame 7, inserting the members 4 first through the slots 30 of template 11 or 12 and pushing them into assembly frame 7 until the leading end of each crosswise member 4 reaches the upright portion 21 of lengthwise beam 17*a* and fits under the edge 21*a* of lengthwise beam 17*a*. If necessary to properly align the crosswise members 4, visible marks can be placed on the upright portion 21 or edge 21*a* of lengthwise beam 17*a* to enable a worker to manually adjust that end of each crosswise member 4 to match up with the slots 30 in template 11 or 12. A worker will then climb onto the timbers now being held by assembly frame 7 and, using the automatic nail gun, insert at least one nail at each intersection of a lengthwise member 3 and a crosswise member 4. The nails used at this step are shorter than the combined thickness of a lengthwise member 3 and a crosswise member 4, so that the tip of the nail does not protrude beyond the bottom surface (as presently placed on assembly frame 7) of the lengthwise members 3. This is especially important with regard to top mats 1, since protruding nail tips would be on the surface of the temporary road. At this point in fabrication, the pins 32 are fully inserted into the upright portion 26 of template 11 or 12.

When this preliminary nailing is completed, a worker controlling the hydraulic machinery causes the hydraulic rams 55 to pull back on piston rods 54, which causes steel piece 53 to pivot counterclockwise (facing FIG. 3) on bolt 58, thereby causing steel pieces 51 and 50 to move upward and clockwise around the axis of axle 25, causing axle 25 to turn clockwise in rings 49, thereby causing assembly frame 7 to pivot upward and clockwise on pivoting end 24 (referring to FIG. 3). While assembly frame 7 is pivoting, the two pins 32 hold the partially-constructed mat within the frame 7. Assembly frame 7 is pivoted 180 degrees clockwise (referring to FIG. 3) until the crosswise members 4 of the partially-constructed mat are lying against the surface 64 of crimping table 10. Workers then pull out the two pins 32 and the hydraulic operator reverses the pivoting action of assembly frame 7, causing the assembly frame 7 to move counterclockwise towards its original position on assembly frame base 8. Because the pins 32 have been pulled, there is nothing to hold the partially-constructed mat onto assembly frame 7, and so the mat falls over edge 21*a* onto crimping table 10 with the lengthwise members 3 on top of crosswise members 4. A worker once again mounts the mat and uses the automatic nail gun to insert nails into each intersection of a lengthwise member 3 with a crosswise member 4. This time, however, the length of each nail is greater than the combined thickness of a lengthwise member 3 and a crosswise member 4, causing the tip of the nail to extend completely through both members and down into of the top of plate 63 of crimping table 10. Because the top plate 63 is of heavy steel, the protruding portion of the nail is automatically crimped back into the crosswise member 4. The mat is now completed and a forklift can remove the mat by inserting the forklift tongues into slots formed by the spacing of the crosswise members 4 of the mat.

While the partially-constructed mat on the crimping table 10 is being nailed, the assembly frame 7 can be returned to its original position on assembly frame base 8 and re-loaded with additional timbers for the construction of the next mat. In this way, a stronger mat can be constructed with nails inserted from both sides of the mat with one side crimped, without a significant increase in the amount of time that would be required to construct a mat using a similar device with only one set of nails.

While this invention has been described by means of a specific example and specific alternative embodiments, it is not to be limited thereto. Obvious modifications will occur to those skilled in the art without departing from the spirit and scope of the invention.

What is claimed is:

1. A structure for positioning component elements of an artificial road construction system into position within a predetermined arrangement, with longitudinal and cross piece components for assembly wherein said structure comprises a base assembly and a top assembly having a pivot to pivotally connect said top assembly to said base assembly, wherein the top assembly of the structure comprises:

a. two exterior longitudinal elements of even length and multiple interior longitudinal elements of even length and base plates between said longitudinal elements, said longitudinal elements forming guide means to guide longitudinal components and wherein the base of said longitudinal elements are positioned horizontally within a single plane and are fastened side to side with each other and said base plates to form a rectangular surface with an outer edge;

b. an end element connected to the end of each of said longitudinal elements;

c. a removable template mounted on one of said exterior longitudinal elements having slots positioned to receive the cross piece components, said other of said exterior longitudinal elements having stop means for stopping the ends of the cross piece components from travel past a predetermined length beyond said slots and an edge extending over said other of said exterior longitudinal elements above the height of the thickness of the cross piece components;

d. holding means mounted on said template for holding some of the components in place;

e. hydraulic means for moving said top assembly one hundred and eighty degrees about said pivot and off of said base assembly;

f. a table sized and positioned to receive said top assembly pivoted said one hundred and eighty degrees about said pivot; and wherein there is further included:

g. a plate located on the upper surface of said table.

2. A structure for positioning component elements of an artificial road construction system into position within a predetermined arrangement, with longitudinal and cross piece components for assembly wherein said structure comprises a base assembly and a top assembly having a pivot to pivotally connect said top assembly to said base assembly, wherein the top assembly of the structure comprises:

a. two exterior longitudinal elements of even length and multiple interior longitudinal elements of even length and base plates between said longitudinal elements, said longitudinal elements forming guide means to guide longitudinal components and wherein the base of said longitudinal elements are positioned horizontally within a single plane and are fastened side to side with each other and said base plates to form a rectangular surface with an outer edge;

b. an end element connected to the end of each of said longitudinal elements;

c. a removable template mounted on one of said exterior longitudinal elements having slots positioned to receive the cross piece components, said other of said exterior longitudinal elements having stop means for stopping the ends of the cross piece components from travel past a predetermined length beyond said slots and an edge extending over said other of said exterior longitudinal elements above the height of the thickness of the cross piece components;

d. holding means mounted on said template for holding some of the components in place;

e. hydraulic means for moving said top assembly one hundred and eighty degrees about said pivot and off of said base assembly;

f. a table sized and positioned to receive said top assembly pivoted said one hundred and eighty degrees about said pivot; and wherein said hydraulic means further includes means for reversing said one hundred and eighty degrees pivot thereby returning said top assembly to rest on said base assembly.

3. Apparatus for construction of temporary decking and roads for use in areas of poor soil conditions comprising a plurality of a first set of substantially identical rectangular units placed in one layer and a second set of substantially identical rectangular units placed in a second layer, wherein each of said first set of units comprises:

a. a first rectangular and substantially planar surface;

b. a second rectangular surface presenting at least five ridges comprising elements arranged transverse to the longitudinal axis of the rectangle, wherein:

i. first and second transverse elements are each disposed so as to be flush with one of the ends of the unit;

ii. one of the remaining transverse elements is approximately equal to the width of the first and second transverse elements;

iii. the rest of the remaining transverse elements are approximately one and one-half times the width of the first and second transverse elements;

iv. said transverse elements are spaced to form at least fourth similar transverse channels of substantially equal dimensions on the second surface; and v. wherein the first and second and one remaining transverse ridge elements are approximately the width of the channels and the remaining transverse elements are approximately one and one-half of the width as the channels;

and wherein each of said second set of units comprises:

c. a first rectangular and substantially planer surface;

d. a second rectangular surface presenting at least four ridges comprising elements arranged transverse to the longitudinal axis of the rectangle, wherein:

i. all transverse elements are of equal width with the outer transverse elements being recessed from the ends of the unit by approximately one-half of the width of the transverse elements;

ii. the transverse elements are spaced to form at least three transverse channels therebetween, two of which are one and one-half times the width of the transverse elements and one of which is twice the width of the transverse elements so that transverse elements of any one of the first units will conform to channels of one-half of any one of the second units.

4. The invention of claim 3, wherein the first rectangular surface of each of said units is formed by a first set of longitudinal and substantially parallel timbers, and wherein the transverse elements comprise second and relatively shorter across timbers.

* * * * *